US006113202A

United States Patent [19]

Germano

[11] Patent Number: 6,113,202

[45] Date of Patent: Sep. 5, 2000

[54] PORTABLE, WALL-MOUNTABLE TOOL BOX-SUPPLY CABINET AND WORK BENCH COMBINATION

[76] Inventor: Charles A. Germano, 1586 Massey Pointe La., Memphis, Tenn. 38120

[21] Appl. No.: 09/260,307

[22] Filed: Mar. 2, 1999

[51] Int. Cl.[7] ..... A47B 67/02; B65D 85/28

[52] U.S. Cl. ..... 312/245; 312/315; 312/244; 206/373

[58] Field of Search ..... 312/245, 244, 312/313, 315, 327; 206/373, 372, 379

[56] References Cited

U.S. PATENT DOCUMENTS

| | | | |
|---|---|---|---|
| 837,224 | 11/1906 | Holcomb | 312/327 |
| 1,177,153 | 3/1916 | Thulander et al. | 312/315 |
| 1,707,021 | 3/1929 | Lea et al. | 312/315 |
| 1,758,238 | 5/1930 | Peterson | 312/245 X |
| 2,015,315 | 9/1935 | McMackin | 312/315 X |
| 2,139,293 | 12/1938 | Wallgren | 206/373 X |
| 2,357,555 | 9/1944 | Seaton | 312/313 |
| 2,615,541 | 10/1952 | Whitesel | 312/315 X |
| 2,999,583 | 9/1961 | Mancini | 312/313 |
| 3,878,939 | 4/1975 | Wilcox . | |
| 4,155,609 | 5/1979 | Skafte et al. | 312/245 |
| 4,241,833 | 12/1980 | Luebcke | 206/373 X |
| 4,303,158 | 12/1981 | Perkins | 206/373 |
| 4,480,744 | 11/1984 | Blackmon | 312/245 X |
| 4,768,652 | 9/1988 | Fallon | 206/373 |

*Primary Examiner*—Peter M. Cuomo
*Assistant Examiner*—Hanh V. Tran
*Attorney, Agent, or Firm*—John J. Mulrooney

[57] ABSTRACT

A sun shield device for automobile includes a tubular central axle, a revolving sleeve which has a diameter larger than and a length shorter than that of the central axle being rotatably supported around the central axle, a shading sheet engaged on and wound around the revolving sleeve, an auto-rewinding device which is installed between the central axle and the revolving sleeve for driving the revolving sleeve to rotate so as to automatically rewind the shading sheet around the revolving sleeve, a supporting device including a pair of supporters extendably connected to two ends of the central axle respectively, and an adjusting device for adjusting the length of at least one of the supporters so as to adjust an overall length of the sun shield device until two supporting end members of the two supporters respectively firmly pressed against two interior side walls of a trunk of an automobile so as to horizontally support the sun shield device within the trunk. Whereby, the user may simply open the trunk cover and pull the shading sheet from the revolving sleeve out of the trunk through the gap formed between the opened trunk cover and trunk edge for at least covering the roof of the automobile.

6 Claims, 3 Drawing Sheets

PORTABLE, WALL-MOUNTABLE TOOL BOX-SUPPLY CABINET AND WORK BENCH COMBINATION

BACKGROUND OF THE INVENTION

1. Field of the Invention

This invention relates to a tool box-supply cabinet and work bench combination and, more particularly, to a portable, wall-mountable tool box-supply cabinet and work bench that is an assembly of parts which are releasably interconnected but not detachable from the assembly, that is deployable from a transport and storage mode to a use mode by pivoting and connecting attached parts, that is collapsible into a thin, compact case for transport and storage, and that is useful either as a freestanding tool box-supply cabinet and work bench or a wall-mounted tool box-supply cabinet and work bench.

2. Description of the Prior Art

Tool boxes and portable work benches have been used by craftsmen, mechanics and home handymen for many years. Such prior devices have attempted to provide such desirable features as a lightweight design for convenient and easy portability and handling, and wall-mounting capacity to save valuable floor space for other necessary tools or equipment. U.S. Pat. No. 4,118,085 discloses a tool cabinet designed for mounting on a wall above a work bench. U.S. Pat. No. D272,111 discloses an ornamental design for a combined work bench and tool cabinet. U.S. Pat. No. 4,819,800 discloses a tool box adapted for wall-mounting and having an open mode permitting tool access and a closed mode for transport. U.S. Pat. No. 5,170,719 discloses a portable, foldable work bench adapted for door-mounting and having three pivoted parts including an upper part consisting of a peg board for temporarily hanging tools while the device is deployed open, a middle part consisting of a horizontal work surface and a lower part consisting of legs that contact the ground to support the work surface.

Various deficiencies and shortcomings are apparent from a consideration of the tool box and work bench apparatus of the prior art. Some prior devices are wheel-mounted and occupy considerable floor space which is not always available or which might be better used for tools and equipment that cannot be used and/or stored without occupying floor space. Some prior devices are relatively heavy and difficult for convenient handling and transport. Some prior devices require the attachment of parts to assemble and the detachment of those same parts to disassemble. Some prior devices are not sturdy enough to withstand heavy duty work such as large weights and forces. Some prior devices are not versatile and adaptable to accommodate tools and equipment having unusual size and shape characteristics.

Accordingly, a need exists for a new and improved lightweight, portable combination tool box-supply cabinet and work bench that is foldable into a thin case, which is easily handled and transported; that is wall-mountable for use and/or storage, whereby floor space is made available for other tools, equipment and/or vehicles; that provides for non-displaceable storage of tools, parts and supplies during transport; that provides a heavy duty work platform that can support substantial weight and withstand substantial forces; that requires no attachment of parts for use or detachment of parts for storage or transport; that provides for simple access to tools and deployment of a work platform by pivoting the work platform from a closed storage/transport mode to a use mode; that has a work platform that is easily adjustable between a closed, vertical position and a plurality of extended positions, whereby the work platform may be positioned horizontally or tilted at an angle as desired; and that, when not in use, the work platform may be pivoted either to a vertical, closure position covering the tool box-supply cabinet or to a vertical, open position 180° from the closure position, whereby the tools and parts are accessible, and thereby providing more useful space in the room, shop, garage or outdoor area where the tool box-supply cabinet is located.

SUMMARY OF THE INVENTION

An object of this invention is to provide a new and improved combination tool box-supply cabinet and work bench.

Another object of the invention is to provide such a combined apparatus that is foldable and wall-mountable for storage to conserve floor space when not in use and that may be deployed and used while mounted on a wall surface.

Another object of the invention is to provide such a combined apparatus that is easily and quickly assembled or disassembled simply by pivoting/connecting parts without any need to attach or detach parts.

Another object of the invention is to provide such a combined apparatus that provides a heavy duty and stable work surface having the capacity to withstand heavy work loads and forces comparable to floor-supported work benches.

Another object of the invention is to provide such a combined apparatus that is deployed for use by pivoting an attached work platform from a vertical stored position to either a horizontal or any of a plurality of angled work positions.

Another object of the invention is to provide such a combined apparatus in which the work platform functions as the closure for the tool box-supply cabinet when the combination device is folded for storage and/or transport.

Another object of the invention is to provide such a combined apparatus that is usable while mounted above floor level and without any need for floor contact or support.

Another object of the invention is to provide such a combined apparatus in which tools, parts and supplies stored therein are not displaced during transport of the apparatus.

Another object of the invention is to provide such a combined apparatus that is lightweight and collapsible into a thin carrying case, yet capable of withstanding heavy duty work loads and forces.

Another object of the invention is to provide a tool box-supply cabinet and work bench unit that is storable on a wall fixture while still providing access to the tools.

Another object of the invention is to provide a tool box-supply cabinet and work bench having a unitary design that is useable as a freestanding apparatus at a job site.

Another object of the invention is to provide a tool box-supply cabinet and work bench unit that is mountable on any wall or column surface and is readily transferable from one mounting location to another with non-restrictive handling.

Another object of the invention is to provide a tool box-supply cabinet and work bench unit that securely holds a variety of different power tools, hand tools and equipment in place regardless of the position/orientation of the unit.

Briefly stated, these objects are accomplished by a combination tool box-supply cabinet and work bench invention consisting of a tool housing having a back panel that is framed by a top panel, a bottom panel and two side panels to define a tool holding well. The back panel has tool clasping fixtures, shelves and storage compartments and containers thereon for holding tools, parts, supplies and equipment. A front panel for the tool housing is pivotally attached to the bottom panel and is pivotable through 180° to be capable of functioning either as a closure for the tool holding well or a work table. The front panel functions as a closure for the tool housing when it is pivoted upwardly to a position covering the tool receiving well. When the front panel is pivoted 90° from its closure position, a pair of work table support members hold the work table in a horizontal position where it is useful as a work bench. When the front panel is pivoted 180° from the closure position, the tool housing is open with the tools, parts, supplies and equipment therein accessible and the front panel deployed vertically down to conserve room space. The tool box-supply cabinet and work bench is foldable to a thin case and has carrying means for convenient transport and handling. The tool box-supply cabinet and work bench may be wall-mounted for storage and/or use, and is portable and useable at work locations where wall-mounting is not possible or desirable.

BRIEF DESCRIPTION OF THE DRAWINGS

A more complete understanding of my invention may be obtained by reference to the accompanying drawings wherein.

DESCRIPTION OF THE PREFERRED EMBODIMENT

Figure 1:
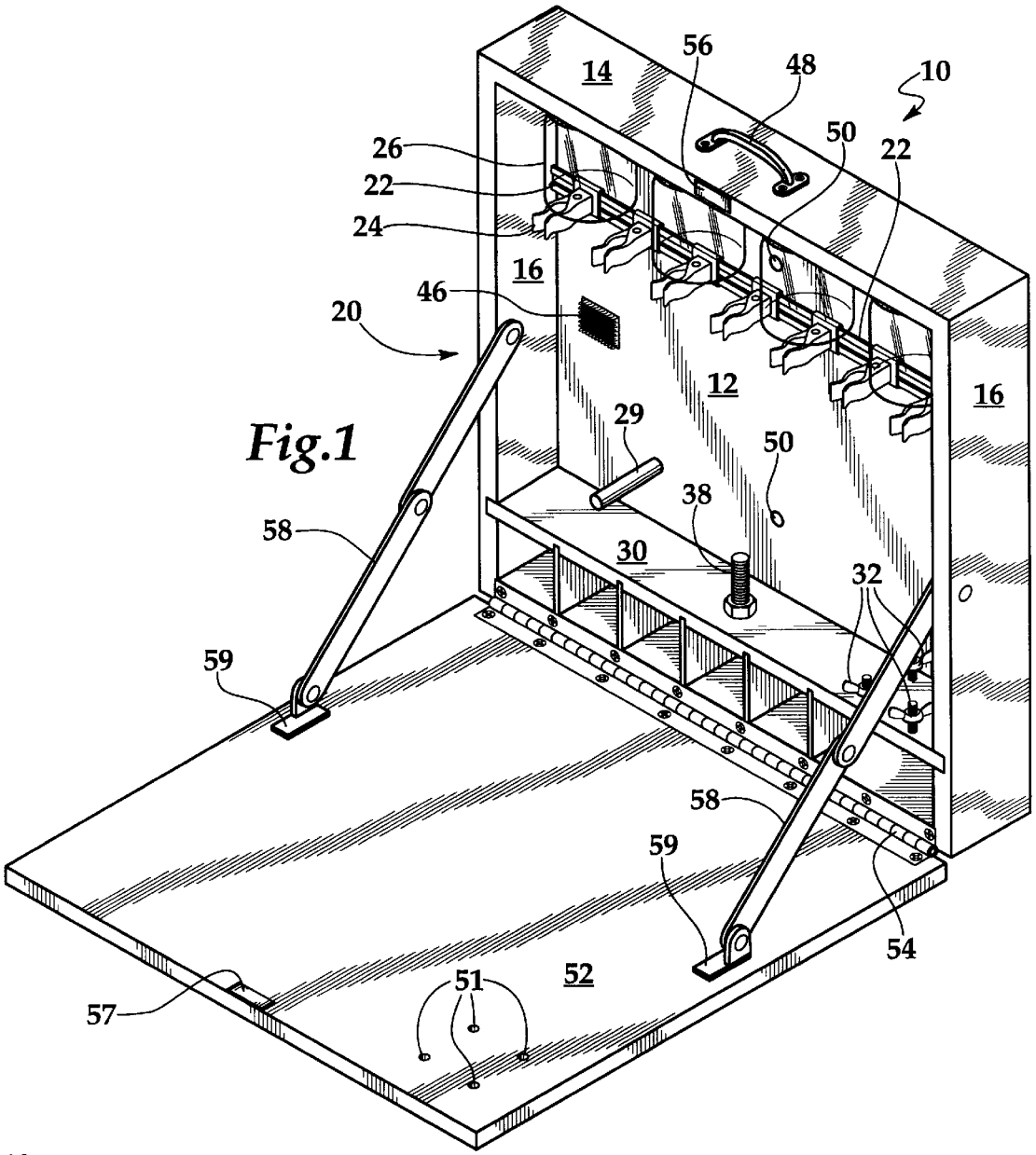
FIG. 1 is a perspective view of my portable, wall-mountable tool box-supply cabinet and work bench invention illustrated with the work table deployed and supported in the horizontal work bench position and without any tools, equipment, parts and supplies secured in the tool receiving well.

Referring to the drawings, the numeral 10 refers generally to a combined tool box-supply cabinet and work bench comprising an assembly of interconnected parts that form a unitary structure. Several parts of the structure are pivotable and/or capable of releasable attachment to other parts, however no parts of the structure are detachable from the unitary structure which comprises the present invention. A tool box consists of a tool holding back panel 12 that is framed by a top panel 14, a pair of side panels 16, and a bottom panel 18 to form an open-sided tool receiving compartment or well 20. Tool receiving well 20 is adapted to securely and conveniently hold the tools, equipment, parts and supplies customarily used by handymen and professional craftsmen. The depth and, therefore, the tool holding capacity of the tool compartment 20 is determined by the width of frame panel members 14, 16 and 18, which is selected to provide sufficient depth to accommodate the sizes and shapes of the tools, supplies and equipment to be stored therein. For example, while a relatively shallow depth will accommodate tools such as pliers, screwdrivers and hammers, a deeper well is required for such tools and equipment such as power sanders, vises and power drills.

The tool receiving well 20 provides a plurality of means that are adapted to receive and securely hold or store a variety of tools, accessories, instruments, equipment, supplies and parts frequently used by professional craftsmen and home handymen. A tool supporting fixture 22 is removably mounted on back panel 12 and has a plurality of tool gripping or clasping members 24 such as clips, clamps or loops for holding tools and/or other items thereon. The removable feature permits the fixture 22 to be selectively positioned in the receiving well 20 to configure and adapt the holder to receive tools and other items as desired. Tool gripping members 24 are removably and/or slideably mounted on tool fixture 22 to permit the individual members 24 to be positioned whereby the holding well 20 can be configured to accommodate tools and other items as required.

A plurality of individual containers such as plastic jars 26 having lids 28 are provided in receiving well 20 for holding such small items as nails, nuts, bolts and washers. The lids 28 can be removably and/or slideably attached to top panel 14, whereby the moveable feature of both the gripping members 24 and containers 26 provides the receiving well 20 with the capacity for a plurality of configurations for receiving and holding a multitude of tools, equipment, parts, and supplies commonly used by craftsmen and handymen.

A post or carriage bolt 29 is affixed to and extends outwardly from the back panel 12. Post 29 has a length such that when the front panel member 52 (described below) covers the tool receiving well 20, the outer end of post 29 will abut against the inner side of the front panel member 52, whereby items looped on post 29 for storage will be not be susceptible to displacement during transport.

A shelf 30 in receiving well 20 extends horizontally across back panel 12 between side panels 16. A plurality of bolts with wing nuts 32 provide for secure storage of items such as a vise 34 and portable saber saw (not shown). A bolt or other stud-like means 38 extends upwardly from shelf 30 and is capable of mating attachment with the standard chuck feature on a power drill 36 to provide means for mounting a power drill on shelf 30 utilizing bolt 38 and the drill chuck feature in a space-saving and secure manner.

A plurality of storage compartment dividers 40 extend vertically between bottom panel 18 and shelf 30 to form a plurality of separate storage compartments 42 for items such as a roll of tape or wire, a tube of caulk or a flashlight. The compartment dividers are removably supported in slots 41 in the top side of bottom panel 18 and slots 43 in the bottom side of shelf 30, whereby the dividers 40 are selectively moveable between slots to form individual storage compartments of particular sizes as needed.

Additional means for securing tools and supplies in receiving well 20 consists of Velcro fasteners illustrated schematically at 46. One part of a Velcro hook and loop fastener is removable attached to back panel 12 and the other part is attached to the item to be secured thereby. The location of Velcro fastener 46 on back panel 12 is changeable whereby Velcro fastener 46 is moveable in conjunction with moveable tool holding clips 24 and containers 26 to configure the tool and supply receiving well 20 for maximum holding and storing capacity. Velcro fastener 46 is useful for securing tools, equipment and accessories such as tape measures, straight edges, plumb lines, tape rolls, multimeters, stud finders, rulers, T-squares and right angles.

It will be apparent that depending on the number, sizes and shapes of the particular tools, parts, equipment and other items placed in the receiving well 20, empty spaces in the well 20 may be available between and beside such items. In order to maximize the holding capacity of the tool box-supply cabinet, it is within the scope of this invention to take advantage of such vacant space by using additional tool grasping and holding fixture means in the form of bolts of various lengths with wing nuts, snap hooks and leaf springs which are selectively mountable on back panel 12 to provide for this additional holding capacity. It will also be apparent that the back panel 12 may be pre-configured to receive and support such additional tool grasping and holding means.

While only one tool fixture 22, one post 29, one shelf 30 and one Velcro fastener 46 are shown in the drawings, it will be appreciated that it is within the scope of this invention that additional fixtures, posts, shelves and Velcro fasteners can be added and configured to provide capacity to receive and hold the myriad of tools, equipment, supplies and parts having the sizes and shapes of items that are customarily stored in tool boxes and supply cabinets.

A carrying means 48 attached to the top panel 14 permits the case to be easily and conveniently lifted and carried. While carrying means 48 is illustrated as a handle, a shoulder strap may be used in addition to, or instead of, a handle or handles.

The combination tool box-supply cabinet and work bench may be mounted on or attached to a wall or support column 44 by well-known means. For example, the back panel 12 has means such as fastener openings 50 to permit the tool housing to be attached to a wall stud or studs 44 by means of hanger bolt fasteners (not shown) or to another surface such as a post 44 for storage and/or use. It will be appreciated that the handles or shoulder strap carrying means 18 can be an alternative or supplemental means to attach or help support the tool box-supply cabinet and work bench on a above-ground surface.

Figure 2:
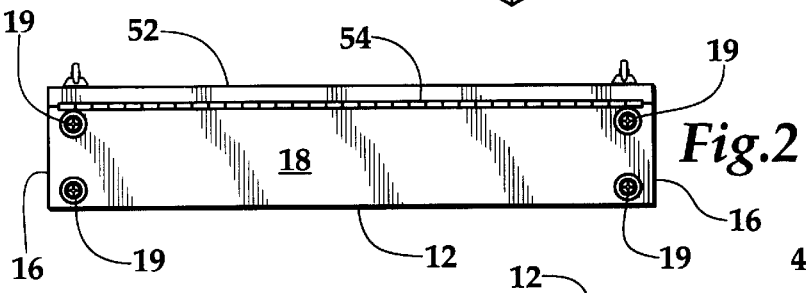
FIG. 2 is a bottom view of my invention illustrating the four feet attached to the underside of bottom panel 18 to provide for leveling when the invention is used as a free-standing tool box-supply cabinet and work bench.
Figure 3:
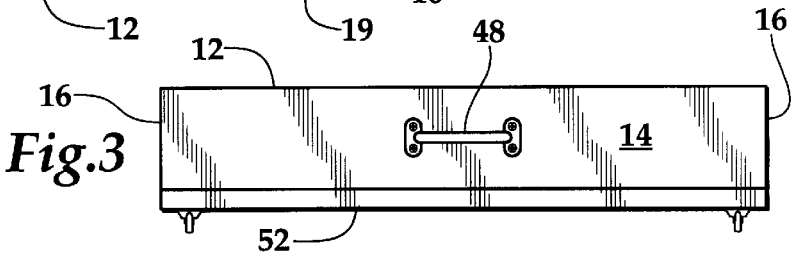
FIG. 3 is a top view of my invention illustrating the thin design of the unit that may be easily carried by a handle mounted atop the case.

The tool box-supply cabinet and work bench has a front panel member 52 that is attached to the front edge of bottom panel 18 by pivoting means such as a hinge 54 that permits member 52 to rotate 180° between vertical up (FIGS. 2 and 3) and vertical down (FIG. 4) positions. When front member 52 is pivoted to an upward vertical position, it covers and provides a front closure panel for tool receiving well 20. When member 52 is pivoted to a horizontal position (FIGS. 1, 5 and 6), member 52 functions as a work bench platform or table. When front panel 52 is pivoted to a vertical down position, the tools and parts stored in receiving well 20 are accessible, but the space occupied when work table 50 is deployed horizontally is available for other uses such as the storage of vehicles.

Latch means 56 and 57 are mounted in mating relationship on the front edge of top panel 14 and at the outer edge of work platform 52, respectively, to secure front panel 52 in the vertical, closed position. The latch means may be magnets which are countersunk in the surfaces of top panel 14 and platform 52 as illustrated, or the latch may comprise a spring clip or bolt type clasp means. As an alternative to separate latch means, the support arms 58 (described below) may be designed to provide a sufficient closure holding force on the front panel-work table 52 when that member is in the vertical closure position, whereby separate latch means are not needed to hold the front panel in the vertical, closed position.

Figure 5:
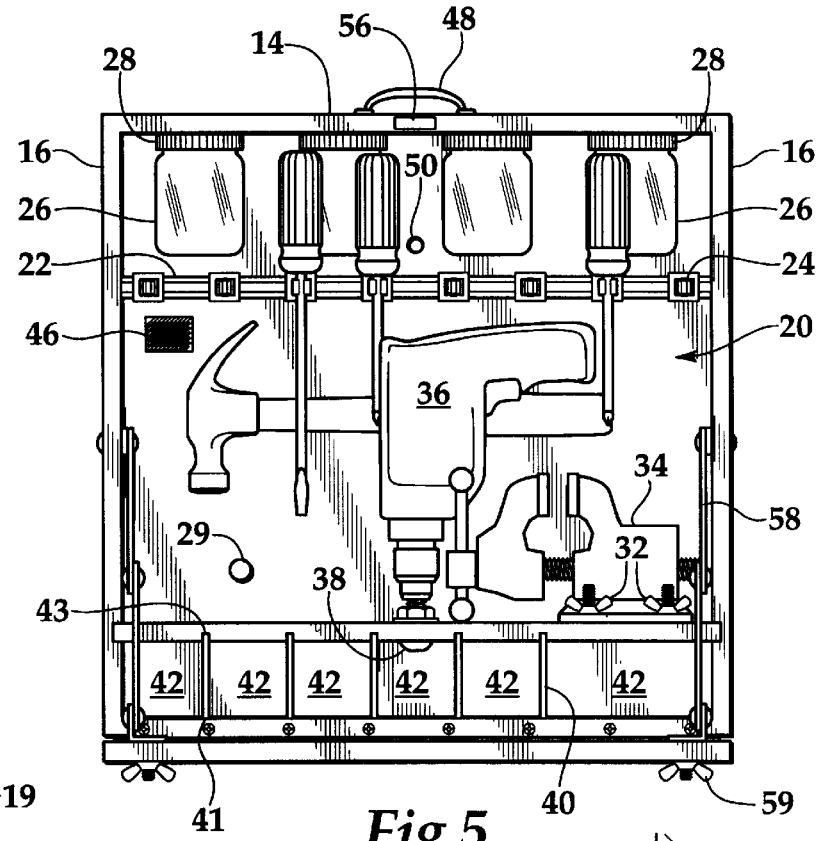
FIG. 5 is a front elevation view of my invention illustrating a possible placement of several tools in the tool receiving well.
Figure 6:
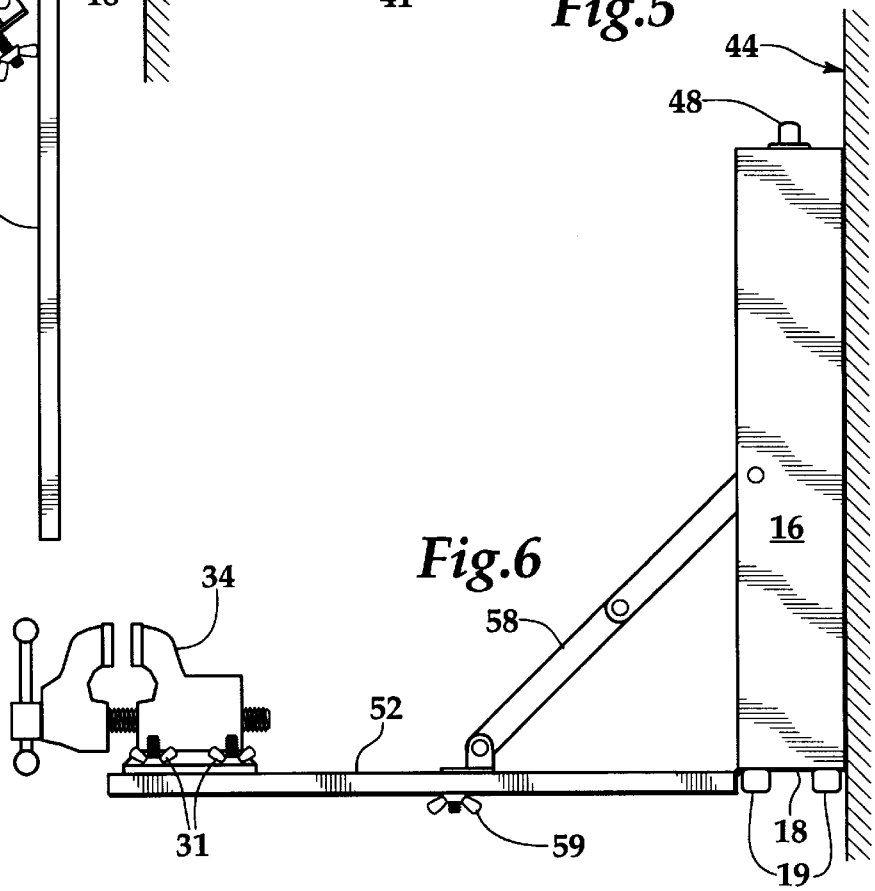
FIG. 6 is a side elevation view of my invention mounted on a vertical surface with the work table deployed in the horizontal work bench position and with a vise mounted on the work table.
Figure 7:
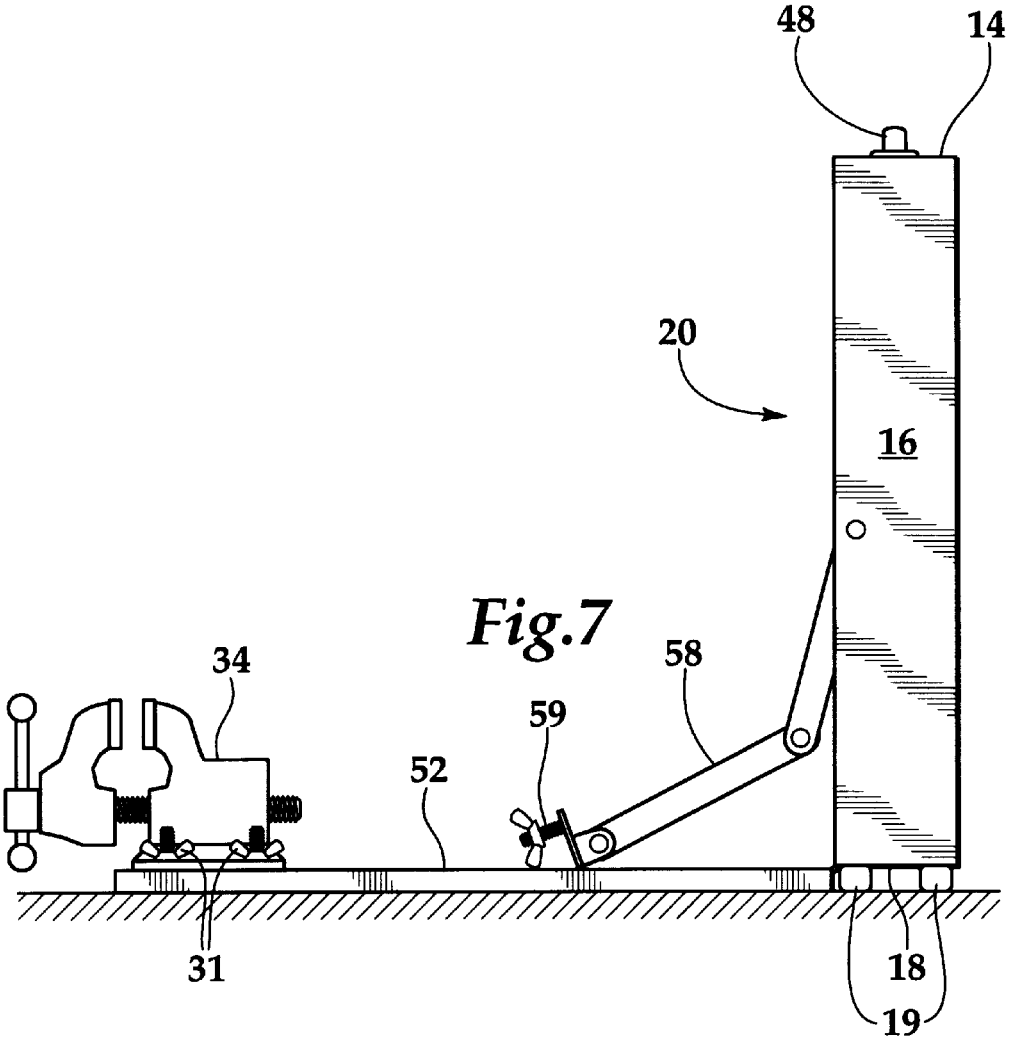
FIG. 7 is a side elevation view of my invention positioned on a floor or ground for use as a freestanding unit

Work table support means 58 support work table 52 in the horizontal position. Support means 58 are illustrated as rotatable, foldable arms 58 that are pivotally connected to side panels 16 and extend to the work table 52. The support means 58 are releasably attached to the work table 52 by brackets and wing nuts 59 or other suitable fastening means as is well-known. The lengths of support means 58 are selected to maintain the work table 30 in a substantially horizontal position. The tensile strength of support arms 58 is selected to provide a work platform having a heavy duty load bearing capacity for supporting work pieces during the performance of jobs such as hammering, sawing, and drilling. When the unit is folded for transport or storage (FIGS. 2 and 3), the support arms 58 may remain attached to work table 52 as shown in FIGS. 5 and 6) or the support arms 58 may be released from work table 52 as shown in FIGS. 4 and 7.

While it is contemplated that the work table 52 will be useful in a horizontal position for most work shop and/or handyman tasks, it will be appreciated that it is within the scope of this invention for support means 58 to be variable in length whereby the work table 52 may be selectively positioned at a plurality of desirable work angles either above or below the horizontal position. This feature is provided, for example, by support means 58 that are variable in length such as telescoping rods, or flexible means such as chains or cables, whereby different lengths of support arms 58 may be selectively used to position the work platform at any of a plurality of desired angles.

Figure 4:
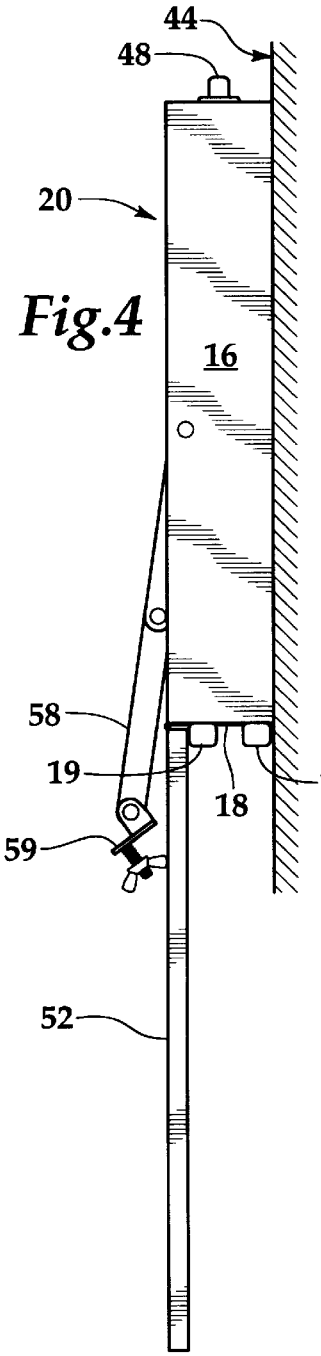
FIG. 4 is a side elevation view of my invention mounted on a vertical surface and with the work table pivoted to a vertical down position.

As shown in FIG. 4, the support means 58 may be disconnected from the work table 52, whereby work table is permitted to pivot to a vertical-down position. In this mode of deployment, the tool box-supply cabinet is wall-mounted for out-of-the-way storage, yet open to allow access to the tools and parts without requiring as much space as when the work table 52 is deployed in the horizontal use position. For example, this feature is particularly useful when the combined tool box-supply cabinet and work bench is wall-mounted in a garage and the user needs access to the tools and parts, but does not need to use the work bench feature of the invention. Pivoting the work table 52 to the vertical-down position (FIG. 4) will allow access to the tool and parts without using horizontal space that may be needed for vehicles.

When the tool box-supply cabinet and work bench is used as a freestanding apparatus (FIG. 7), such as when wall-mounting is not possible or desirable, the work table 52 is pivoted to the horizontal position and the apparatus is positioned on a level surface such as ground or floor. Four feet 19 are attached at the corners of the underside of bottom panel 18. The feet 19 may be made of rubber with recessed screw holes in the center thereof for permitting attachment to bottom panel 18. The four feet 19 are coplanar with the horizontally deployed work table 52, whereby the underside of work table 52 and the four feet 19 contact the ground or floor and provide a leveling and stabilizing effect to the freestanding tool box-supply cabinet and work bench apparatus. Also, feet 19 support the apparatus when it is folded to case mode and rested or stored on the floor.

It will be apparent that this combination tool box-supply cabinet and work bench invention can be constructed of various materials, such as metal or wood or plastic, or a combination of metal, wood and plastic.

This invention of a new and improved combination tool box-supply cabinet and work bench is lightweight, portable and wall-mountable, yet heavy duty and sturdy and provides for the secure, non-displaceable storage of tools, parts and equipment commonly used by professional craftsmen and home handymen. It will be appreciated that changes could be made to the embodiments described above without departing from the inventive concept thereof. It is understood, therefore, that this invention is intended to cover all modifications which are within the spirit and scope of the invention as defined by the appended claims.

What is claimed is:

1. A portable, wall-mountable combination tool box-supply cabinet and work bench comprising:

a tool housing having a back panel, a top panel, two side panels and a bottom panel, whereby said top and bottom panels and said side panels frame said back panel to form an open-sided tool receiving well;

a work table pivotally attached to said bottom panel, said work table being pivotable between a first position providing a closure over said tool receiving well, a second position 90° from said first position, and a third position 180° from said first position;

a plurality of tool holding fixtures mounted on said back panel, said plurality of tool holding fixtures including a post affixed to and extending outwardly from said back panel, said post having an outer end that abuts against said work table when said work table is in said first position;

means for supporting said work table in said second position, whereby said work table provides a substantially horizontal work platform; and means attached to said tool housing for carrying said tool housing and for mounting said tool housing on a wall.

2. The portable, wall-mountable combination tool box-supply cabinet and work bench of claim 1 wherein said means for supporting said work table in said second position comprise flexible members pivotally connected to said tool housing and releasably connected to said work table.

3. The portable, wall-mountable combination tool box-supply cabinet and work bench of claim 1 wherein said means for supporting said work table in said second position comprise extendable, foldable arms pivotally connected to said tool housing and releasably connected to said work table.

4. The portable, wall-mountable combination tool box-supply cabinet and work bench of claim 1 further comprising an opening in said back panel for mounting said tool housing on a wall.

5. The portable, wall-mountable combination tool box-supply cabinet and work bench of claim 1 further comprising:

a shelf on said back panel;

means extending upright from said shelf for mating to an electric drill chuck.

6. The portable, wall-mountable combination tool box-supply cabinet and work bench of claim 1 further comprising leveling means attached to the underside of said bottom panel for leveling and stabilizing said combination when used as a freestanding apparatus on a flat surface.

* * * * *

UNITED STATES PATENT AND TRADEMARK OFFICE

CERTIFICATE OF CORRECTION

PATENT NO. : 6,113,202
DATED : September 5, 2000
INVENTOR(S) : Charles A. Germano It is certified that error appears in the above-identified patent and that said Letters Patent is hereby corrected as shown below:

The Abstract for a sun shield invention printed on the Title Page is deleted and is replaced with the following:

ABSTRACT

PORTABLE, WALL-MOUNTABLE TOOL BOX-SUPPLY CABINET AND WORK BENCH COMBINATION

A portable, wall-mountable tool box-supply cabinet and work bench combination consists of a tool housing having a back panel that is framed by a top panel, a bottom panel and two side panels to define a tool receiving well. The tool receiving well has tool-clasping, -holding fixtures, shelves, containers and compartments therein for holding tools, parts, supplies and equipment in a secure manner such that the tools, parts, supplies and equipment will remain in place during transport. A front panel for the tool housing is pivotally attached to the bottom panel and is rotatable from a vertical closure position covering the tool receiving well, to a horizontal work bench position providing a work platform, to a vertical position 180° from the closure position providing access to tools, parts, supplies and equipment in the tool box-supply cabinet. The tool box-supply cabinet and work bench is a unitary assembly of parts that are releasably interconnected, but that are not individually separable from the assembly. The tool box-supply cabinet and work bench is foldable to a thin, portable case that is capable of being easily handled, that is wall-mountable for storage and/or use, and that is useful as a freestanding tool box-supply cabinet and/or work bench at locations where wall mounting is not possible or desirable.

Signed and Sealed this

Twenty-fifth Day of September, 2001

*Attest:*

Nicholas P. Godici

NICHOLAS P. GODICI

*Attesting Officer*

*Acting Director of the United States Patent and Trademark Office*